US009188126B2

(12) United States Patent
Shin et al.

(10) Patent No.: US 9,188,126 B2
(45) Date of Patent: Nov. 17, 2015

(54) HERMATIC COMPRESSOR HAVING A FLUID GUIDE DISPOSED IN AN INTERMEDIATE CHAMBER

(71) Applicant: LG ELECTRONICS INC., Seoul (KR)

(72) Inventors: Jinung Shin, Seoul (KR); Bumdong Sa, Seoul (KR); Yunhi Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 30 days.

(21) Appl. No.: 14/051,879

(22) Filed: Oct. 11, 2013

(65) Prior Publication Data

US 2014/0105774 A1 Apr. 17, 2014

(30) Foreign Application Priority Data

Oct. 12, 2012 (KR) ..... 10-2012-0113797

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 11/00*** | (2006.01) |
| ***F04C 23/00*** | (2006.01) |
| ***F04C 29/02*** | (2006.01) |
| *F04C 18/356* | (2006.01) |

(52) U.S. Cl.

CPC ..... *F04C 23/008* (2013.01); *F04C 23/001* (2013.01); *F04C 29/028* (2013.01); *F04C 18/356* (2013.01); *F04C 2240/806* (2013.01)

(58) Field of Classification Search

CPC .... F04C 23/008; F04C 23/001; F04C 18/356; F04C 18/3564; F04C 29/028; F04C 29/128; F04C 2240/806

USPC ..... 418/11, 60, 270

See application file for complete search history.

(56) References Cited

U.S. PATENT DOCUMENTS

| | | | | |
|---|---|---|---|---|
| 4,269,576 | A * | 5/1981 | Shibuya | 418/97 |
| 2008/0240954 | A1 * | 10/2008 | Morozumi et al. | 418/11 |
| 2011/0165004 | A1 * | 7/2011 | Park et al. | 418/11 |

FOREIGN PATENT DOCUMENTS

| | | | | |
|---|---|---|---|---|
| CN | 1959116 | A | 5/2007 | |
| CN | 101072951 | A | 11/2007 | |
| CN | 102251964 | A | 11/2011 | |
| EP | 2 441 961 | A1 | 4/2012 | |
| JP | 2000009072 | A * | 1/2000 | F04C 29/00 |
| JP | 2007113542 | A * | 5/2007 | F04C 29/12 |
| JP | 2008-240667 | A | 10/2008 | |

OTHER PUBLICATIONS

Chinese Office Action issued in Application No. 201310474583.7 dated Jul. 15, 2015.

* cited by examiner

*Primary Examiner* — Theresa Trieu
(74) *Attorney, Agent, or Firm* — Ked & Associates LLP

(57) ABSTRACT

A hermetic compressor is provided that may include a fluid guide disposed in an inner space of an intermediate chamber, so as to guide oil, discharged from a first compression chamber of a first compression device into the inner space of the intermediate chamber, to a second compression chamber of a second compression device without remaining in the inner space of the intermediate chamber, whereby noise generated due to an excessive amount of oil remaining in the inner space of the intermediate chamber may be reduced, and simultaneously a shortage of oil in the second compression device may be prevented.

17 Claims, 6 Drawing Sheets

HERMATIC COMPRESSOR HAVING A FLUID GUIDE DISPOSED IN AN INTERMEDIATE CHAMBER

CROSS-REFERENCE TO RELATED APPLICATION(S)

Pursuant to 35 U.S.C. §119(a), this application claims priority to Korean Application No. 10-2012-0113797, filed in Korea on Oct. 12, 2012, the contents of which is incorporated by reference herein in its entirety.

BACKGROUND

1. Field

A hermetic compressor is disclosed herein.

2. Background

In general, a hermetic compressor may include, within an inner space thereof, a motor that generates a driving force, and a compression device that compresses a refrigerant by receiving the driving force from the motor. Hermetic compressors may be classified as a single-stage hermetic compressor or a multi-stage hermetic compressor according to a number of cylinders. The single-stage hermetic compressor includes one suction pipe coupled to one cylinder, whereas the multi-stage hermetic compressor includes a plurality of suction pipes coupled to a plurality of cylinders, respectively.

The multi-stage hermetic compressor may be divided into a 1-suction and 2-discharge type and a 1-suction and 1-discharge type according to a method of compressing a refrigerant. The 1-suction and 2-discharge type (or 2-suction and 2-discharge type) is a compressor having a plurality of cylinders connected to one suction pipe in a diverging manner or connected to a plurality of suction pipes, respectively, such that each of the plurality of cylinders compresses a refrigerant and discharges the compressed refrigerant into an inner space of a hermetic casing. On the other hand, the 1-suction and 1-discharge type is a compressor having a first cylinder of a plurality of cylinders connected to a primary suction channel, and a second cylinder connected to a discharge side of the first cylinder through a secondary suction channel, such that a refrigerant is compressed by two stages to be discharged from the second cylinder into an inner space of a hermetic casing. The 1-suction and 1-discharge type may be referred to as a two-stage compression type hermetic compressor.

FIG. 1 is a longitudinal sectional view of a two-stage compression type hermetic compressor according to the related art. As illustrated in FIG. 1, in the related art two-stage compression type hermetic compressor 1, a first compression chamber S1 of a first cylinder 2 and a second compression chamber S2 of a second cylinder 3 may be independently installed in a hermetic casing 10. An inlet of the first cylinder 2 may be connected to a suction pipe 4, and an outlet of the second cylinder 3 may communicate with the hermetic casing 10.

An intermediate chamber 5, which has a predetermined inner space S3 to temporarily receive a first-stage compressed refrigerant, may be formed below the first cylinder 2. The intermediate chamber 5 may be connected to the second compression chamber S2 of the second cylinder 3 through a secondary suction channel 6, which may serve as an inner communication path.

Unexplained reference numeral 7 denotes a drive motor, and 8 denotes an accumulator in FIG. 1.

With such a configuration of a two-stage compression type hermetic compressor according to the related art, a refrigerant sucked into the first cylinder 2 through the suction pipe 4 may be first-stage compressed in the first compression chamber S1 to be discharged into the intermediate chamber 5. The first-stage compressed refrigerant may then be introduced into the second compression chamber S2 of the second cylinder 3 through the secondary suction channel 6, and then two-stage or second-stage compressed in the second compression chamber S2 of the second cylinder 3. The two-stage compressed refrigerant may be discharged into the inner space of the hermetic casing 10. This series of processes may be repetitively executed.

A first pressure reduction may be caused while or when the refrigerant is sucked into the first compression chamber S1 of the first cylinder 2, and a second pressure reduction may be caused while or when the refrigerant is discharged from the first compression chamber S1 of the first cylinder 2 into the intermediate chamber 5 to be introduced into the second compression chamber S2 of the second cylinder 3 through the secondary suction channel 6. In the related art, to reduce pressure and pressure pulsation, the inner space S3 of the intermediate chamber 5 is formed as large as possible and a cross section of the secondary suction channel 6 is also large.

However, when the reduction of the pressure and the pressure pulsation is derived by increasing a volume of the intermediate chamber 5 and the cross section of the secondary suction channel 6, as shown in the related art two-stage compression type hermetic compressor, as illustrated in FIG. 2, an oil accumulation in the inner space S3 of the intermediate chamber 5 is caused due to an inlet of the secondary suction channel 6 being formed at an upper end of the intermediate chamber 5. This may cause the inner space S3 of the intermediate chamber 4 to become narrower, which may aggravate or reduce the second pressure reduction. Also, the second cylinder 3 may suffer from a frictional loss due to a relative shortage of oil.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of embodiments, with reference to the accompanying drawings. For the sake of brief description with reference to the drawings, the same or equivalent components will be provided with the same reference numbers, and description thereof will not be repeated.

Figure 1:
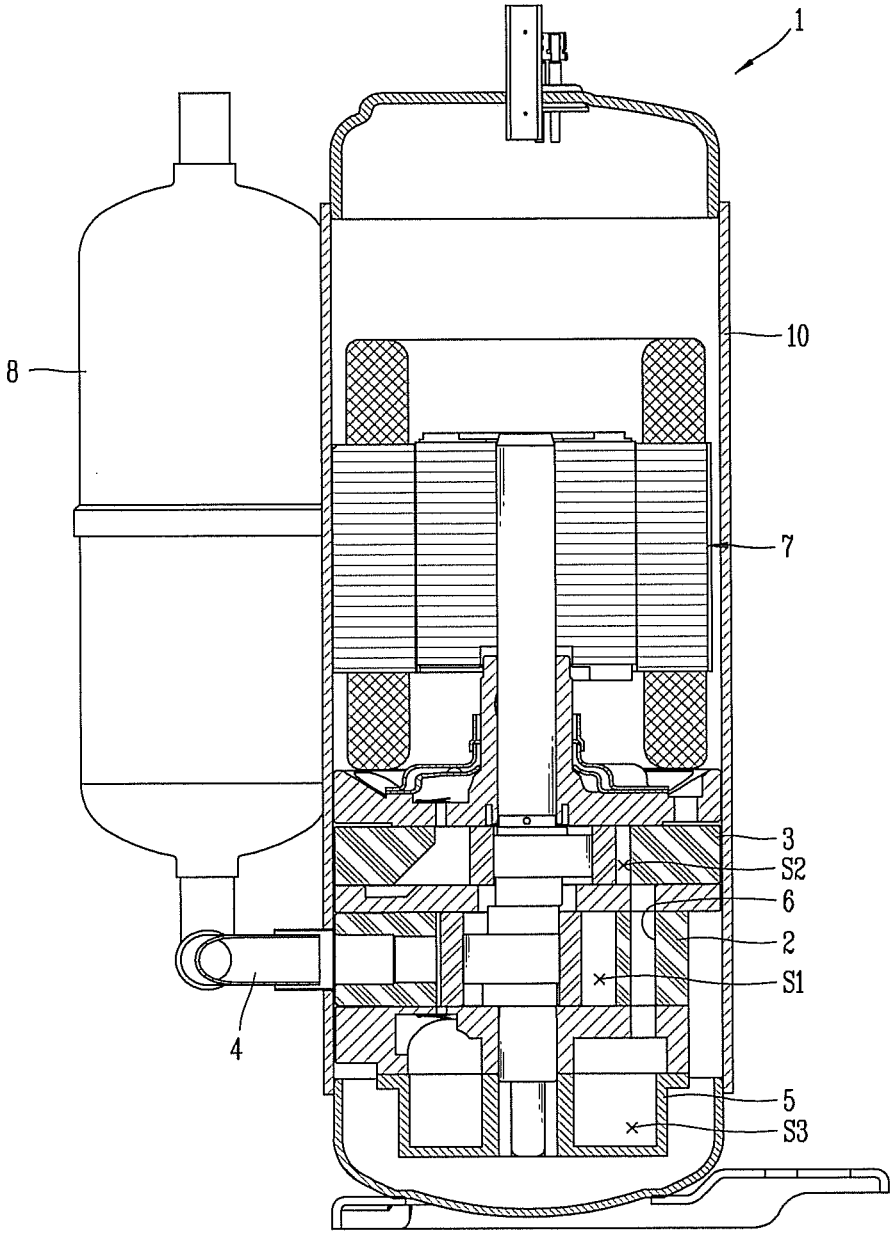
FIG. 1 RELATED ART
FIG. 1 is a longitudinal sectional view of a two-stage compression type hermetic compressor according to the related art.
Figure 2:
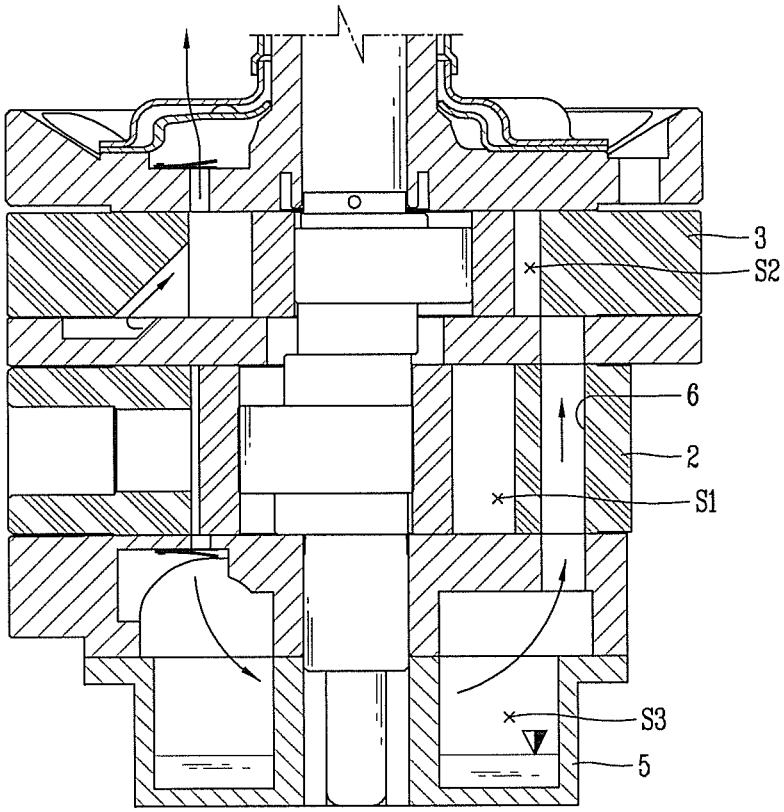
FIG. 2 RELATED ART
FIG. 2 is a longitudinal sectional view illustrating flows of a refrigerant and oil in an intermediate chamber of the compressor of FIG. 1.
Figure 3:
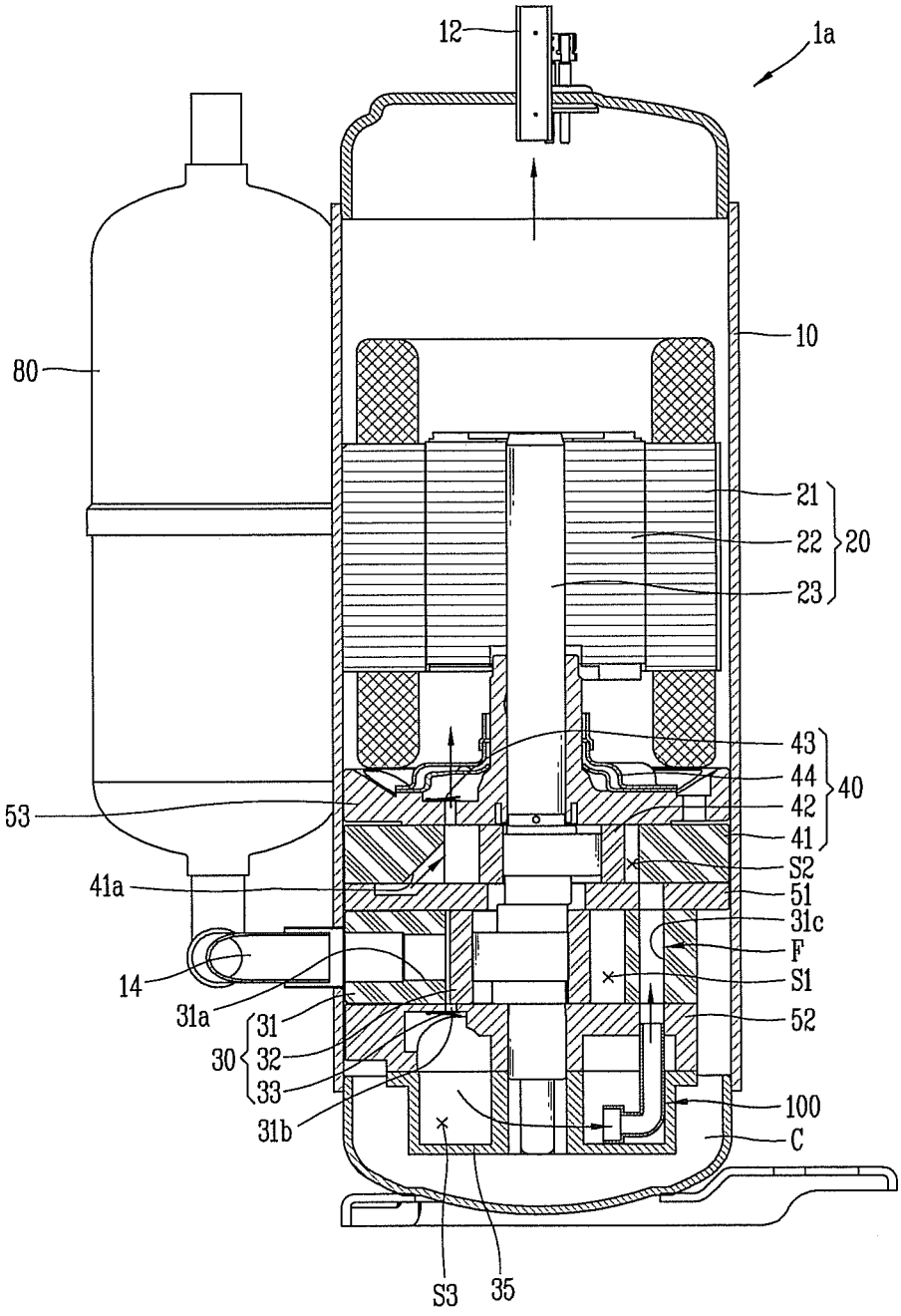
FIG. 3 is a longitudinal sectional view of a two-stage compression type rotary compressor in accordance with an embodiment.
Figure 4:
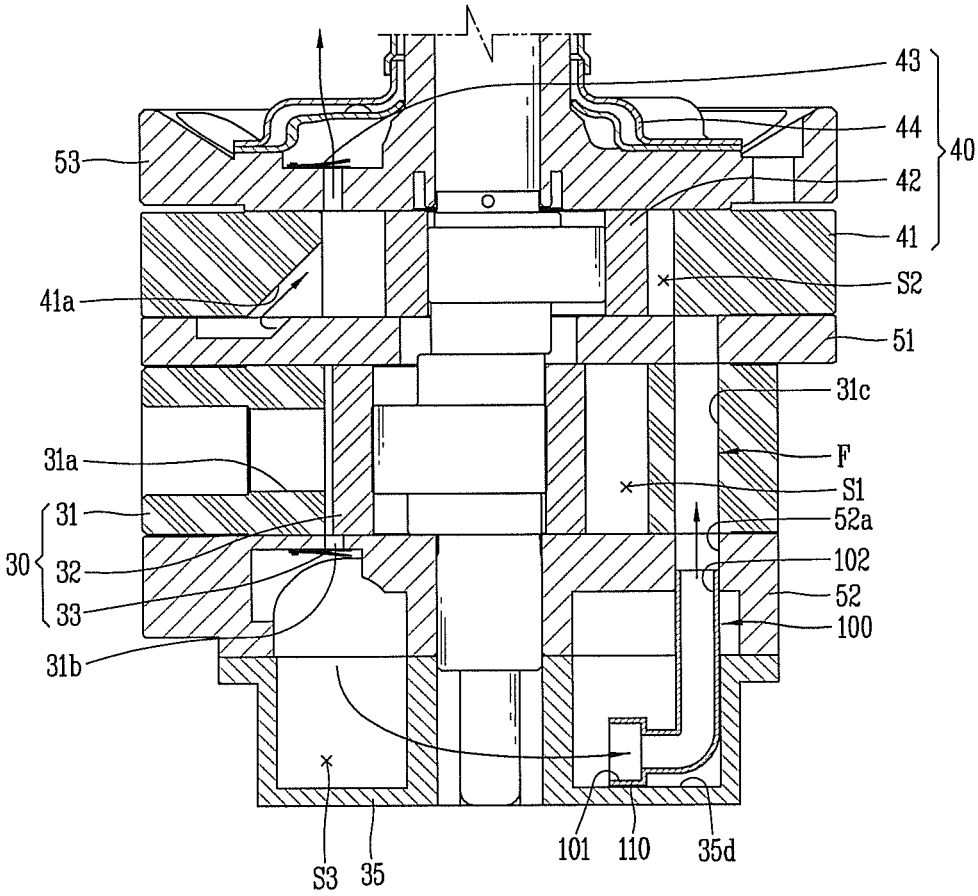
FIG. 4 is a longitudinal sectional view illustrating flows of a refrigerant and oil in an intermediate chamber in the compressor of FIG. 3.

FIG. 3 is a longitudinal sectional view of a two-stage compression type rotary compressor in accordance an embodiment, and FIG. 4 is a longitudinal sectional view illustrating flows of a refrigerant and oil in an intermediate chamber in the compressor of FIG. 3. As illustrated in FIGS. 3 and 4, a two-stage compression type rotary compressor 1*a* according to this embodiment may include a motor 20 installed in or at an upper side of an inner space of a hermetic casing 10 to generate a driving force, and a compression device C installed in or at a lower side of the inner space of the hermetic casing 10 to execute a two-stage compression of a refrigerant using a rotational force generated in or by the motor 20.

The compression device C may include a first compression device 30 and a second compression device 40 installed on or at both sides of an intermediate plate 51 to compress a refrigerant in a sequential manner, a lower bearing plate (hereinafter, referred to as a lower bearing) 52 installed on or at a lower end of the first compression device 30 and forming a first compression chamber S1 of the first compression device 30 together with a lower surface of the intermediate plate 51, and an upper bearing plate (hereinafter, referred to as an upper bearing) 53 installed on or at an upper end of the second compression device 40 and forming a second compression chamber S2 of the second compression device 40 together with an upper surface of the intermediate plate 51.

The first compression device 30 may include a first cylinder 31, a first rolling piston 32, a first vane (not shown), and a first discharge valve 33. The second compression device 40 may include a second cylinder 41, a second rolling piston 42, a second vane (not shown), a second discharge valve 43, and a discharge muffler 44.

The intermediate plate 51 may be installed between the first cylinder 31 and the second cylinder 41 so as to separate the first compression chamber S1 of the first cylinder 31 from the second compression chamber S2 of the second cylinder 41.

The first cylinder 31 may include an inlet 31*a* forming a primary suction channel. The inlet 31*a* may be connected to an accumulator 80 through a suction pipe 14. An outlet (not shown) of the first cylinder 31 may communicate with an intermediate chamber 35, which may be coupled to the first cylinder 31, via a communication hole 31*b*. The intermediate chamber 35 may communicate with the second compression chamber S2 through a communication hole 31*c*, which may form a secondary suction channel F to be explained later, and an inlet 41*a* of the second cylinder 41. An outlet (not shown) of the second cylinder 41 may communicate with an inner space of the hermetic casing 10 through the discharge muffler 44, and the inner space of the hermetic casing 10 may be connected to a refrigerating system through a discharge pipe 12.

Unexplained reference numeral 21 denotes a stator, 22 denotes a rotor, and 23 denotes a rotation shaft in FIG. 3.

A rotary compressor having the above-described configuration may operate as follows.

When the rotor 22 is rotated in response to power applied to the stator 21 of the motor 20, the rotation shaft 23 may be rotated together with the rotor 22 to transfer a rotational force of the motor 20 to the first compression device 30 and the second compression device 40. Accordingly, the first rolling piston 32 and the second rolling piston 42 in the first compression device 30 and the second compression device 40 may perform an orbiting motion, so as to form the first compression chamber S1 and the second compression chamber S2 together with the first vane and the second vane, respectively.

A gaseous refrigerant, which may be separated from a liquid refrigerant in the accumulator 80, may be introduced into the first compression chamber S1 of the first cylinder 31 through the suction pipe 14 to be first-stage compressed in the first compression chamber S1. The first-stage compressed refrigerant may then be introduced into the intermediate chamber 35 through the outlet of the first cylinder 31. The first-stage compressed refrigerant introduced into the intermediate chamber 35 may be sucked into the second compression chamber S2 of the second cylinder 41 through the secondary suction channel F to be two-stage compressed in the second compression chamber S2 of the second cylinder 41. The two-stage compressed refrigerant may be discharged into the inner space of the hermetic casing 10 through the outlet of the second cylinder 41. This series of processes may be repetitively performed.

Oil, which may be mixed with the first-stage compressed refrigerant in the first compression chamber S1 of the first cylinder 31, may be discharged into the inner space S3 of the intermediate chamber 35. The oil may remain in the inner space S3 of the intermediate chamber 35 due to pressure pulsation and an oil circulating rate, which is a so-called oil accumulation. When the oil accumulation is caused in the inner space S3 of the intermediate chamber 35, an excessive amount of oil may accumulate in the inner space S3 of the intermediate chamber 35. This may cause a second pressure reduction, and also may result in a frictional loss in the second compression device 40 due to a shortage of oil introduced into the second compression chamber S2 of the second cylinder 41.

According to this embodiment, a fluid guide 100 may be installed in the intermediate chamber 35 to allow refrigerant and oil discharged from the first compression chamber S1 of the first cylinder 31 into the intermediate chamber 35 to smoothly flow into the second compression chamber S2 of the second cylinder 41. Accordingly, the oil accumulation in the inner space S3 of the intermediate chamber 35 may be prevented, and simultaneously, the oil may be smoothly supplied into the second compression device 40.

Figure 5:
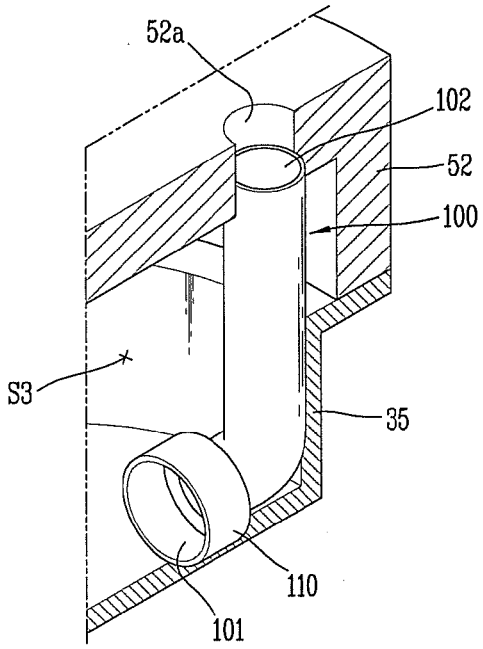
FIG. 5 is a perspective view of a fluid guide in the compressor of FIG. 3 according to an embodiment.
Figure 6:
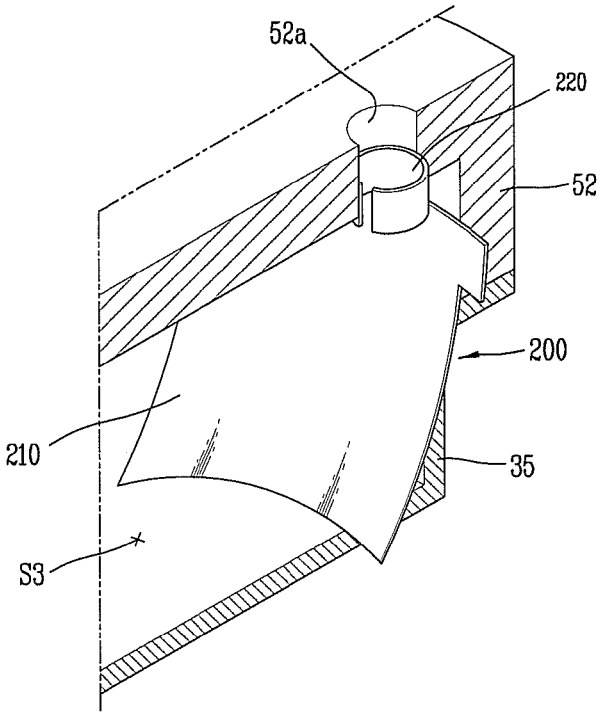
FIG. 6 is a perspective view of a fluid guide in the compressor of FIG. 3 according to another embodiment.

The fluid guide 100 according to this embodiment, as illustrated in FIGS. 4 and 5, may be in the form of a pipe, which may have a shape similar to a mark "¬." An inlet 101 of the fluid guide 100 may be brought into contact with a lower portion of the inner space S3 of the intermediate chamber 35, for example, a bottom surface 35*d* of the inner space S3 of the intermediate chamber 35. This may allow the oil remaining in the inner space S3 of the intermediate chamber 35 to be smoothly sucked into the second cylinder 41 by a suction force of the second compression device 40.

The inlet 101 of the fluid guide 100 may have an extending portion 110 with an increased inner diameter so as to effectively suck oil near or adjacent the fluid guide 100 therein. An outlet 102 of the fluid guide 100 may be fixedly inserted into a communication hole 52*a* of the lower bearing 52, which may form a portion of the secondary suction channel F, so as to increase a coupling force.

When the fluid guide 100 is installed in the inner space S3 of the intermediate chamber 35, oil discharged from the first compression chamber S1 of the first cylinder 31 into the inner space S3 of the intermediate chamber 35 may be induced into the second cylinder 41 through the fluid guide 100 without remaining in the inner space S3 of the intermediate chamber 35. Accordingly, noise, which may be generated when an excessive amount of oil remains in the inner space S3 of the intermediate chamber 35, may be reduced, and a shortage of oil in the second compression device 40 may be prevented.

Hereinafter, description will be given of a fluid guide according to another embodiment.

That is, with the previous embodiment, the fluid guide is shown formed in the shape of a pipe. However, with this embodiment, the fluid guide is shown formed in the shape of a plate disposed at a front of an inner side wall surface of intermediate chamber 35. That is, with this embodiment, a fluid guide 200 may have a guide portion 210, which may be formed in a curved shape with a predetermined curvature or in a shape inclined toward secondary suction channel F, to smoothly guide gas and oil toward the secondary suction channel F.

An elastically fixed portion 220 having the shape of a C-ring may be formed on or at an upper end of the fluid guide 200. The elastically fixed portion 220 may be inserted into the secondary suction channel F (or communication hole 52*a*) to be elastically fixed thereto.

The fluid guide 200 having the configuration described above may be similar to the previous embodiment with respect to a basic operation effect. With this embodiment, as the guide portion 210 of the fluid guide 200 is formed in the shape of a plate, flow resistance of refrigerant may be further reduced in comparison to the previous embodiment so as to allow for smooth flow of the refrigerant; however, a suction force for the oil may be a little bit reduced as well. However, as an inlet of the secondary suction channel F is located on or at an upper end of the inner space S3 of the intermediate chamber 35, relatively heavy oil may be effectively introduced into the second cylinder 41, as compared with the related art, in which such oil is unable to be sucked into the secondary suction channel F.

Hereinafter, description will be given of a fluid guide according to another embodiment.

That is, the foregoing embodiments illustrate the fluid guides 100 and 200 as separately fabricated and thereafter installed in inner space S3 of intermediate chamber 35. With this embodiment illustrated in FIG. 7, a guide hole 35*b* forming a fluid guide 300 may be formed in intermediate chamber 35 so as to configure a part of secondary suction channel F.

Figure 7:
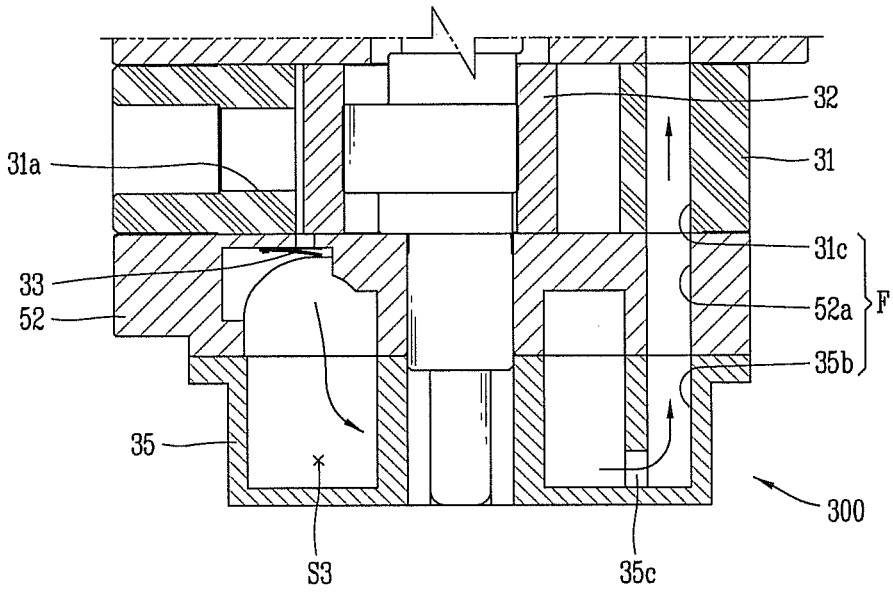
FIG. 7 is a longitudinal sectional view of a fluid guide formed in the intermediate chamber of the compressor of FIG. 3 according to another embodiment.

As illustrated in FIG. 7, the guide hole 35*b* may be formed through an inner circumferential surface of the inner space S3 of the intermediate chamber 35 and extend toward an upper end of the intermediate chamber 35. An inlet 35*c* of the guide hole 35*b* may be formed at a lower portion of the inner space S3, namely, adjacent to bottom surface 35*d* of the inner space S3.

When the guide hole 35*b* is formed in the intermediate chamber 35, a volume of the inner space S3 of the intermediate chamber 35 may be slightly reduced; however, processing and assembly of the fluid guide may be improved as compared with separately fabricating and assembling the fluid guide.

As the fluid guide may be installed on the bottom surface of the intermediate chamber, oil discharged from the first cylinder into the inner space of the intermediate chamber may flow into the second cylinder through the fluid guide without remaining in the inner space of the intermediate chamber. This may prevent lowering of a reduction effect of noise, which may be generated due to an excessive amount of oil remaining in the inner space of the intermediate chamber, and also prevent a shortage of oil in the second compression device.

Embodiments disclosed herein illustrate that the fluid guide may be installed in an intermediate chamber applied to a two-stage compression type compressor; however, embodiments are not so limited. That is, the fluid guide according to embodiments may also be applicable to a 1-suction and 2-discharge (or 2-suction and 2-discharge) type multi-stage compressor. In this case, an intermediate chamber may be formed at a discharge side of a cylinder, which may be located at a relatively lower side, and a communication hole may be formed through both cylinders, such that the intermediate chamber may communicate with a discharge side of another cylinder located at an upper side. Also, a fluid guide may be coupled to the communication hole in a manner that an outlet of the fluid guide may be inserted into a lower end of the communication hole. As refrigerant and oil discharged into the intermediate chamber may be guided into the communication hole by the fluid guide, a problem that oil remains in the intermediate chamber may be prevented from being caused in advance.

Embodiments disclosed herein provide a hermetic compressor, capable of minimizing oil accumulation within an inner space of an intermediate chamber, located between a first compression chamber and a second compression chamber, by reducing flow resistance of the oil in the intermediate chamber.

Embodiments disclosed herein provide a hermetic compressor that may include a hermetic casing, a first cylinder installed in the hermetic casing, and having a first compression chamber, a second cylinder installed in the hermetic casing, and having a second compression chamber spaced from the first compression chamber, an intermediate chamber installed at an outlet side of the first compression chamber or an outlet side of the second compression chamber, and a fluid guide installed in the intermediate chamber and configured to guide fluid introduced into an inner space of the intermediate chamber to an outside of the intermediate chamber.

Embodiments disclosed herein further provide a hermetic compressor that may include a hermetic casing, a first cylinder installed in the hermetic casing, and having a first compression chamber, a second cylinder installed in the hermetic casing, and having a second compression chamber in which a refrigerant compressed in the first cylinder is two-staged compressed, and an intermediate chamber installed between the first compression chamber and the second compression chamber, and having a predetermined inner space to communicate the first compression chamber and the second compression chamber with each other. The intermediate chamber may be provided therein with a fluid guide configured to guide fluid, discharged from the first compression chamber into the inner space of the intermediate chamber, toward the second compression chamber.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hermetic compressor, comprising:

a hermetic casing;

a first cylinder installed in the hermetic casing, the first cylinder having a first compression chamber;

a second cylinder installed in the hermetic casing, the second cylinder having a second compression chamber spaced from the first compression chamber;

an intermediate plate installed between the first cylinder and the second cylinder that separates the first compression chamber from the second compression chamber;

a lower bearing plate installed on a lower end of the first cylinder;

an upper bearing plate installed on an upper end of the second cylinder;

an intermediate chamber provided at an outlet side of the first compression chamber or at an inlet side of the second compression chamber;

a secondary suction channel formed through the lower bearing plate, the first cylinder, and the intermediate plate to communicate between the first compression chamber and the second compression chamber; and a fluid guide installed in the intermediate chamber and configured to guide a fluid introduced into an inner space of the intermediate chamber outside of the intermediate chamber, wherein an inlet of the fluid guide is located at a lower end portion of the intermediate chamber.

2. The compressor of claim 1, wherein the inlet of the fluid guide extends into the intermediate chamber.

3. The compressor of claim 1, wherein an outlet of the fluid guide is inserted into a secondary suction channel.

4. The compressor of claim 3, wherein the fluid guide is in a shape of a pipe.

5. The compressor of claim 4, wherein the fluid guide comprises an extending portion formed at the inlet thereof, and wherein the extending portion has an inner diameter greater than an inner diameter of the outlet of the fluid guide.

6. The compressor of claim 3, wherein the fluid guide comprises a guide portion formed at the inlet thereof, and wherein the guide portion has a shape of a plate.

7. The compressor of claim 6, wherein the fluid guide comprises an elastically fixed portion formed at the outlet thereof, and wherein the elastically fixed portion is inserted into the secondary suction channel to be elastically supported therein.

8. The compressor of claim 6, wherein the guide portion of the fluid guide is curved.

9. The compressor of claim 1, wherein the fluid guide extends through a side wall of the intermediate chamber.

10. The compressor of claim 9, wherein the inlet extends through an inner circumferential wall of the intermediate chamber and the outlet is formed at adjacent a top of the intermediate chamber.

11. A hermetic compressor, comprising:

a hermetic casing;

a first cylinder installed in the hermetic casing, the first cylinder having a first compression chamber;

a second cylinder installed in the hermetic casing, the second cylinder having a second compression chamber in which a refrigerant compressed in the first cylinder is two-stage compressed;

an intermediate plate that separates the first compression chamber from the second compression chamber, disposed between the first cylinder and the second cylinder;

a first bearing plate and a second bearing plate that form the first compression chamber and the second compression chamber disposed at a side surface of the first cylinder and a side surface of the second cylinder, respectively;

an intermediate chamber installed on the first bearing plate to communicate the first compression chamber and the second compression chamber with each other; and a secondary suction channel formed through the first bearing plate, the first cylinder, and the intermediate plate, wherein the secondary suction channel guides the refrigerant, discharged from the first compression chamber into the intermediate chamber, to the second compression chamber, wherein the intermediate chamber is provided therein with a fluid guide configured to guide a fluid, discharged from the first compression chamber into an inner space of the intermediate chamber, toward the second compression chamber, wherein the fluid guide communicates with the secondary suction channel, and wherein an inlet of the fluid guide extends into the intermediate chamber.

12. The compressor of claim 11 wherein an outlet of the fluid guide is inserted into the secondary suction channel, and wherein the inlet of the fluid guide is located at a lower end portion of the intermediate chamber.

13. The compressor of claim 11, wherein the fluid guide is in a shape of a pipe.

14. The compressor of claim 13, wherein the fluid guide comprises an extending portion at the inlet thereof, and wherein a diameter of the inlet of the fluid guide is greater than a diameter of the outlet thereof.

15. The compressor of claim 11, wherein the fluid guide is in a form of a curved plate disposed at an inner side wall of the intermediate chamber.

16. A hermetic compressor, comprising:

a hermetic casing;

a first cylinder installed in the hermetic casing, the first cylinder having a first compression chamber;

a second cylinder installed in the hermetic casing, the second cylinder having a second compression chamber spaced from the first compression chamber;

an intermediate chamber provided at an outlet side of the first compression chamber or at an inlet side of the second compression chamber;

a secondary suction channel formed between the first compression chamber and the second compression chamber, to guide a refrigerant from the first compression chamber into the second compression chamber, the refrigerant being compressed in the first compression chamber and discharged into the intermediate chamber; and a fluid guide installed in the intermediate chamber and configured to guide a fluid introduced into an inner space of the intermediate chamber outside of the intermediate chamber, wherein the fluid guide comprises a guide portion formed at an inlet thereof, wherein the guide portion has a shape of a plate, wherein the fluid guide further comprises an elastically fixed portion formed at an outlet thereof, and wherein the elastically fixed portion is inserted into the secondary suction channel to be elastically supported therein.

17. A hermetic compressor, comprising:

a hermetic casing;

a first cylinder installed in the hermetic casing, the first cylinder having a first compression chamber;

a second cylinder installed in the hermetic casing, the second cylinder having a second compression chamber spaced from the first compression chamber;

an intermediate chamber provided at an outlet side of the first compression chamber or at an inlet side of the second compression chamber;

a secondary suction channel formed between the first compression chamber and the second compression chamber, to guide a refrigerant from the first compression chamber into the second compression chamber, the refrigerant being compressed in the first compression chamber and discharged into the intermediate chamber; and a fluid guide installed in the intermediate chamber and configured to guide a fluid introduced into an inner space of the intermediate chamber outside of the intermediate chamber, wherein the fluid guide extends through a side wall of the intermediate chamber, and wherein an inlet of the fluid guide extends through an inner circumferential wall of the intermediate chamber and an outlet of the fluid guide is formed adjacent to a top of the intermediate chamber so as to connect with the secondary channel.

* * * * *